US005473129A

United States Patent [19]

Markowski et al.

[11] Patent Number: 5,473,129

[45] Date of Patent: Dec. 5, 1995

[54] ENVIRONMENTAL ELECTRIC SWITCH ENCLOSURE WITH VIEWING WINDOW

[75] Inventors: Robert G. Markowski, East Haven; Jon P. McCuin, Bristol; Gary P. Michaelis, Oakville; George J. Boucher, Plainville, all of Conn.

[73] Assignee: General Electric Company, New York, N.Y.

[21] Appl. No.: 140,929

[22] Filed: Oct. 25, 1993

[51] Int. Cl.[6] ..... H01H 1/64

[52] U.S. Cl. ..... 200/293; 200/43.22; 200/333; 52/208

[58] Field of Search ..... 200/293, 43.22, 200/333, 61, 62, 308, 47, 297; 52/171.1, 205, 208; 99/341; 126/190, 200

[56] References Cited

U.S. PATENT DOCUMENTS

| | | | |
|---|---|---|---|
| 3,227,831 | 1/1966 | Jacks et al. | 200/5 A |
| 4,107,488 | 8/1978 | Keller et al. | 200/333 |
| 4,110,584 | 8/1978 | Erickson et al. | 200/304 |
| 4,778,959 | 10/1988 | Sabatella et al. | 200/144 R |
| 5,243,161 | 8/1993 | Cox et al. | 200/308 |
| 5,276,299 | 1/1994 | Marsh | 200/47 |

*Primary Examiner*—Henry J. Recla
*Assistant Examiner*—David J. Walczak
*Attorney, Agent, or Firm*—Richard A. Menelly

[57] ABSTRACT

An electric disconnect switch enclosure for outdoor applications includes a viewing window to visually ascertain the ON-OFF conditions of the switch contacts without having to motivate the switch handle or open the enclosure door. The viewing window can be formed in the enclosure door in an automated manufacturing process.

3 Claims, 4 Drawing Sheets

ENVIRONMENTAL ELECTRIC SWITCH ENCLOSURE WITH VIEWING WINDOW

BACKGROUND OF THE INVENTION

U.S. Pat. Nos. 3,227,831; 4,110,584 and 5,243,161 each describe electric disconnect switches having a viewing window in the front cover of the switch enclosure to visually ascertain the true condition of the switch contacts.

Each of the above-noted enclosures describes fastening devices that are used to attach the viewing window support to the enclosure door. The screws, rivets and other such metal fasteners require additional time and expense during manufacture and also limit the resistance of the enclosure to adverse outdoor environmental conditions. When such switch enclosures are submerged in water during in-process tests, there is a possibility that the water could seep by the openings that capture the metal fasteners.

One purpose of the invention is to provide an electric disconnect switch enclosure that doesn't utilize openings through the enclosure door to attach the viewing window.

An additional purpose of the invention is to describe an electric switch enclosure that includes a viewing window that is formed within the enclosure door in an automated assembly operation.

SUMMARY OF THE INVENTION

The invention comprises an electric disconnect switch assembly contained within an enclosure that is resistant to adverse environmental conditions while providing visual access to the ON-OFF conditions of the switch contacts. The viewing window support in one embodiment is punch-formed from the door material in an automated process.

DESCRIPTION OF THE PREFERRED EMBODIMENT

Figure 1:
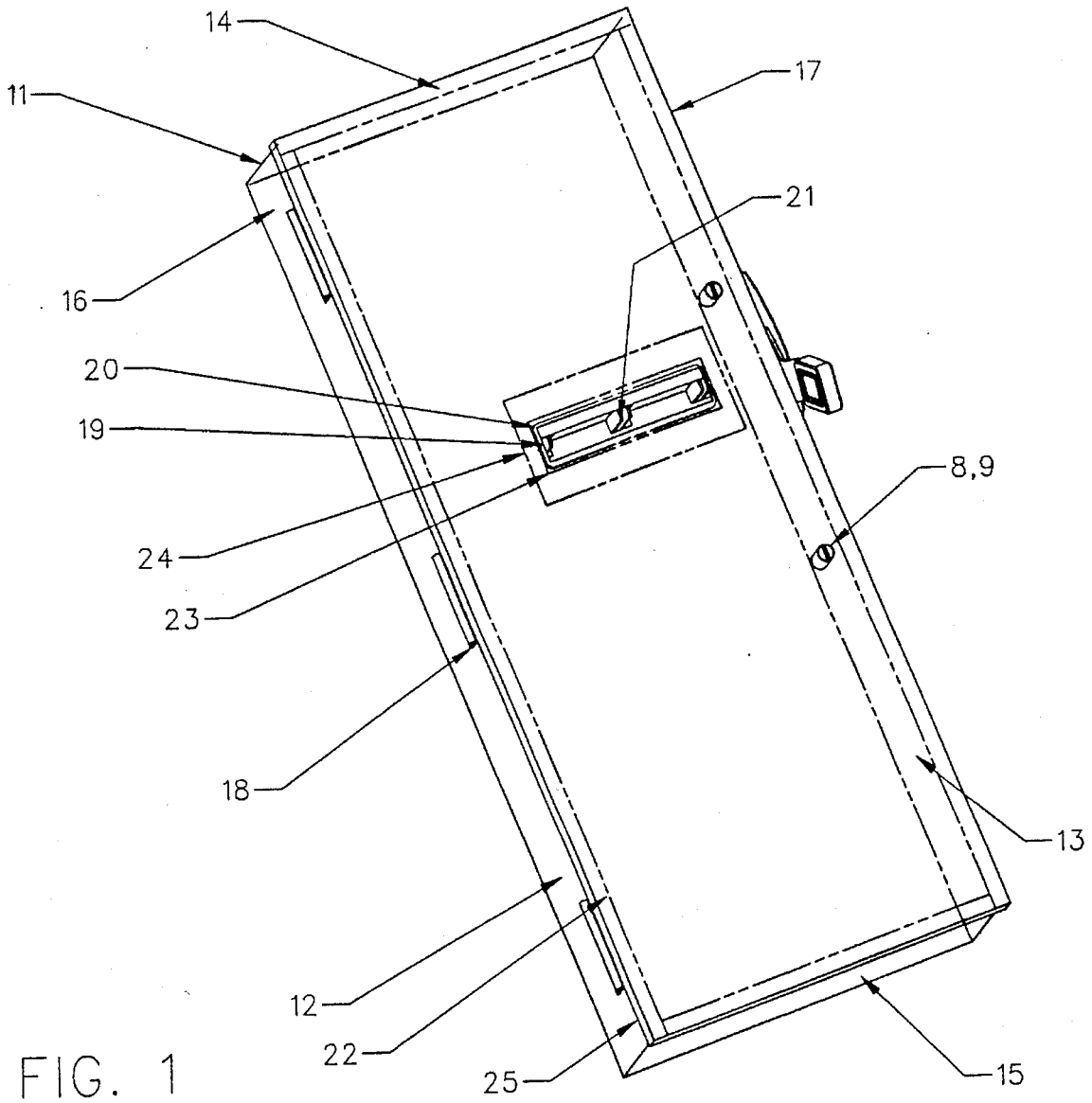
FIG. 1 is a front perspective view of an electric switch enclosure containing the viewing window assembly according to the invention.

An electric disconnect switch enclosure 10 is shown in FIG. 1 in the form of a housing 11 with opposing sides 12, 13 and a top 14 and bottom 15. The enclosure is closed at the rear by means of a back 16 and at the front by means of a door 17. The door is attached to the side 12 by means of hinges 18 and is retained in the closed position shown in FIG. 1 by means of a pair of spring-loaded latches 9 which are released by means of rotation of the tool access slots 8. The door is environmentally sealed by the overlap provided by means of the perimetric rim 25 on the edges of the door and by means of the gasket 22 attached to the undersurface thereof. To provide actual indication of the condition of the contacts 21 which form part of the disconnect switch, although not shown, is similar to that described within U.S. Pat. No. 4,778,959 entitled "Fused Disconnect Switch". Since the relevant Electric Codes require that the switch contacts become opened prior to allowing the door to open, it is oftentimes inconvenient to turn off the switch before opening the door to assure that the contacts are operational. A viewing window 20 is arranged on the door to allow inspection of the contacts without having to open the door. The window is attached to the inner surface of the door by means of a window support frame 24 and is environmentally sealed by means of a gasket 23 arranged about the rectangular opening 19 cut within the door.

Figure 2:
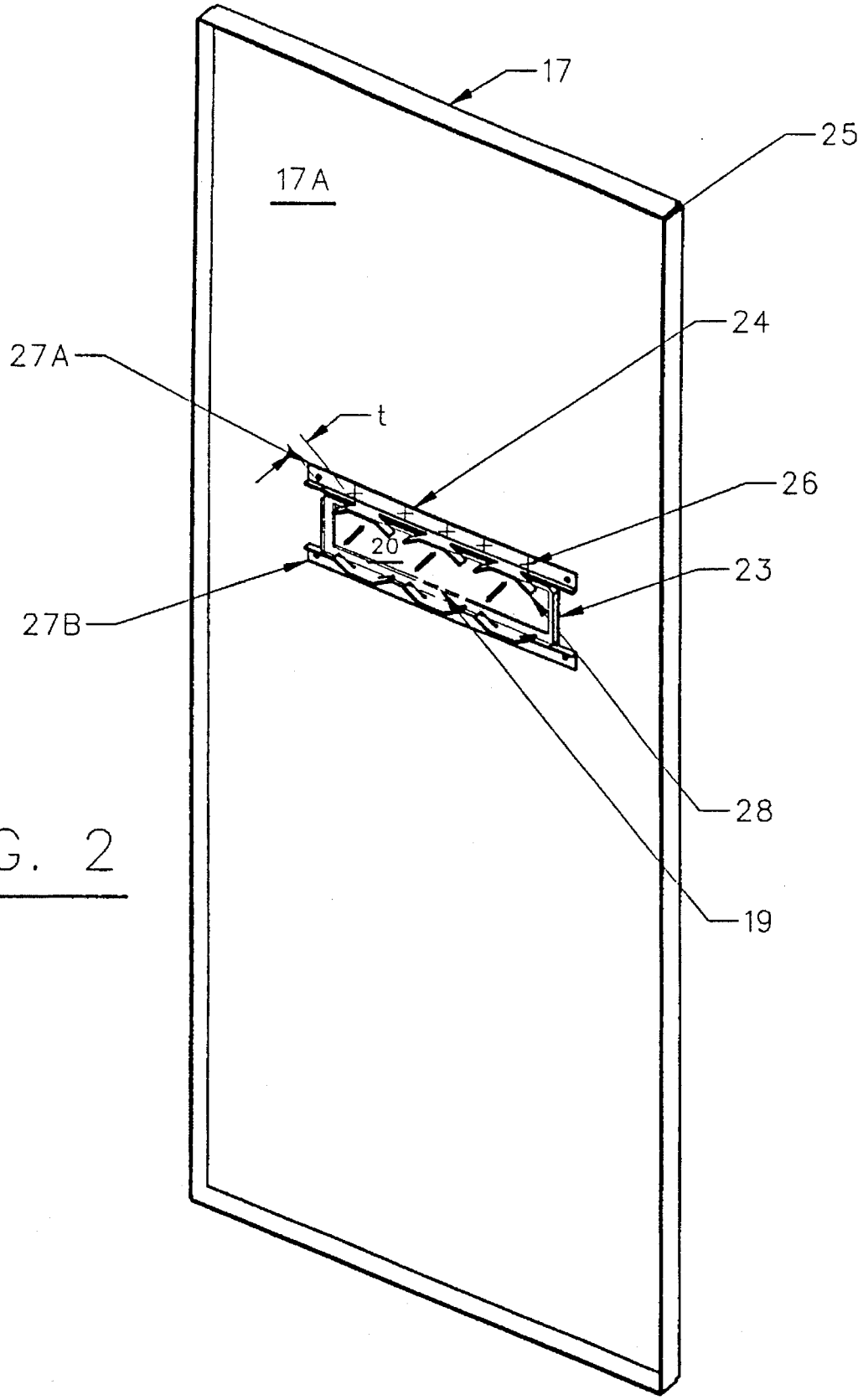
FIG. 2 is an enlarged partial front perspective view of the inside surface of the door of FIG. 1 depicting one window assembly according to the invention.

The inner surface 17A of the door 17 is depicted in FIG. 2 to describe a window support structure 24 that does not require screws, rivets or other fasteners which would drilling holes through the door. An angular metal strap 27A is attached to the inner surface at the top of the rectangular aperture 19 by spot-welding as indicated at 26 and an opposite metal strap 27B is attached at the bottom in a similar manner. The top and bottom straps are mirror images of the same design to reduce manufacturing costs. The metal straps are shaped to provide six or more tabs 28 that extend perpendicular from the inner surface and extend a distance t from the surface which distance corresponds to the thickness of the glass, acrylic, or polycarbonate material used to form the window 20. With the glass pressed tightly against the gasket the tabs are then depressed in the direction of the plane of the window to trap the window tightly against the gasket in a press-fit relation. The tight fit of the window against the gasket insures against any leakage or seepage around the perimeter of the aperture. The ledges 35 extending from the angular straps function to guide and support the window both during and after installation.

Figure 3:
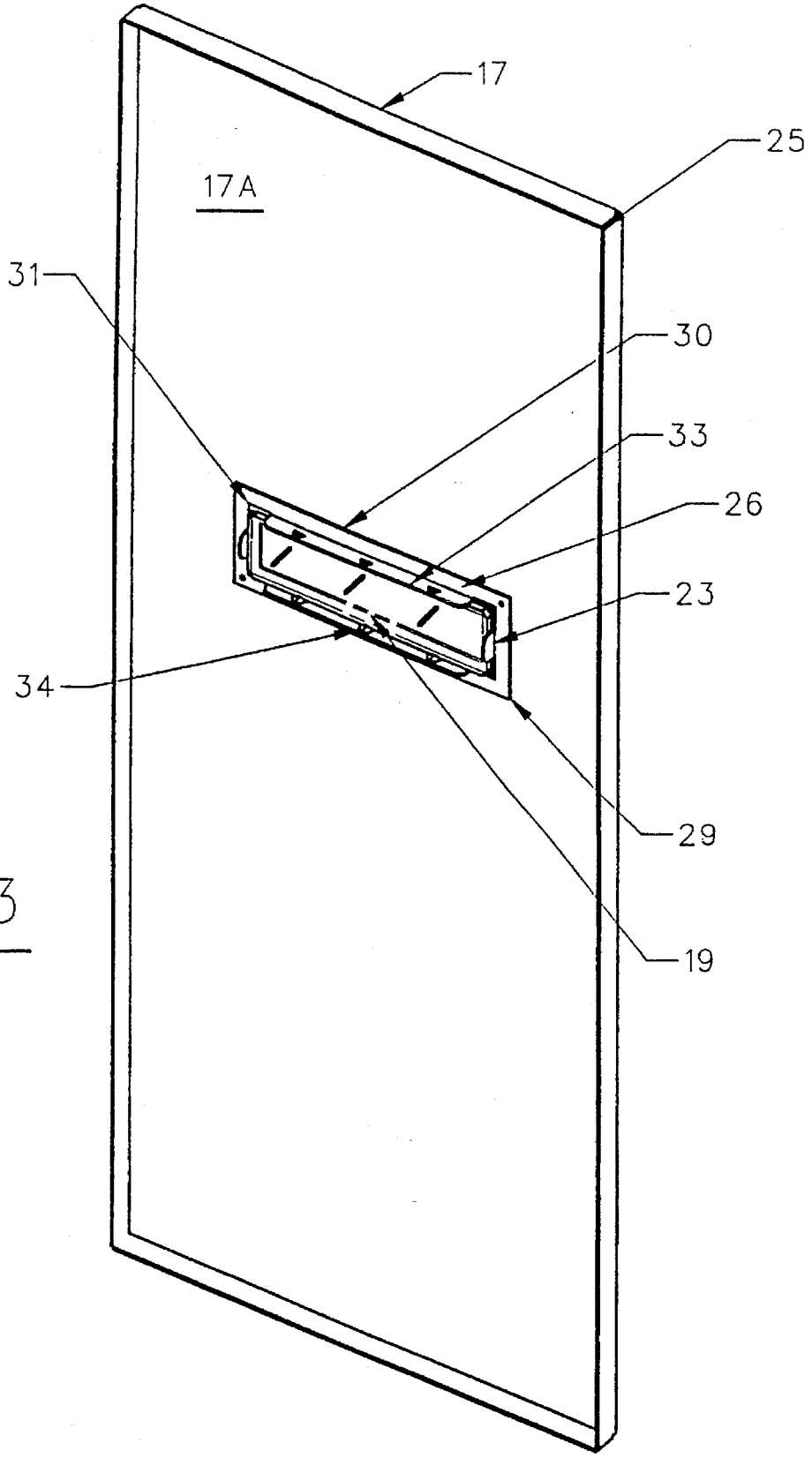
FIG. 3 is an enlarged partial front perspective view of the inside surface of the door of FIG. 1 depicting another window assembly according to the invention.

A unitary window support frame 29 is shown in the door 17 depicted in FIG. 3. The frame consists of a perimetric rim 30 that defines an inner rectangular slot 31 that is positioned coextensive with the rectangular aperture 19. An upper lip 32 and a lower lip 33 extend perpendicular from the perimetric rim and are provided with a plurality of lanced tabs 34 to retain the window 20. A pair of opposing side tabs, indicated at 36, provide side support to the window when installed between the upper and lower lips 32, 33 and pushed past the lanced tabs 34 which capture the window and prevent the window from becoming displaced. In the manner described earlier, the gasket 23 is compressed between the window and the inner surface 17A to provide excellent environmental protection. The unitary window support frame is also spot-welded to the inner surface 17A as indicated at 26 to avoid the requirement of through holes which would otherwise jeopardize the long term withstand to adverse outdoor exposure.

Figure 4:
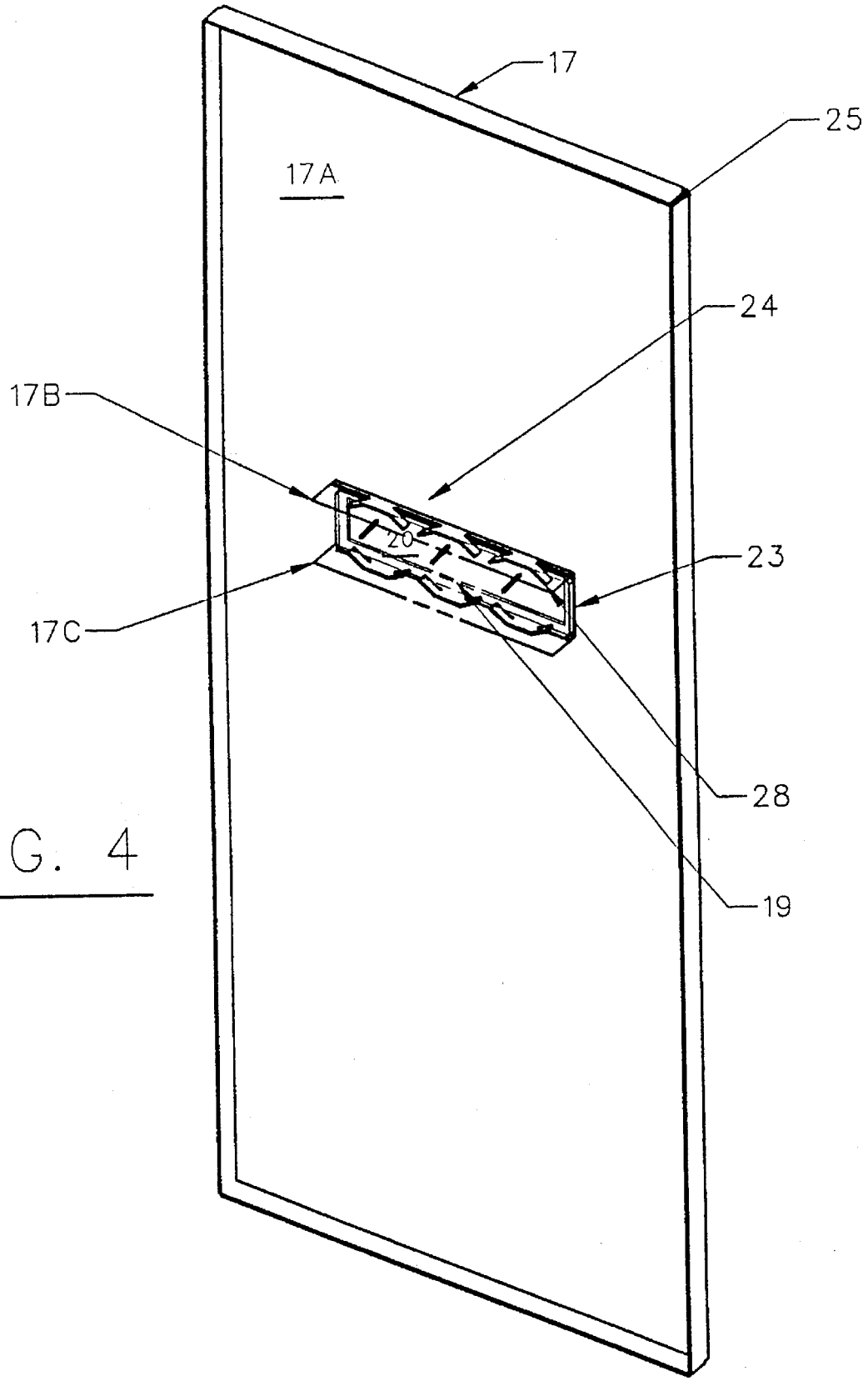
FIG. 4 is an enlarged partial front perspective view of the inside surface of the door of FIG. 1 depicting a further window assembly according to the invention.

The door 17 depicted in FIG. 4 multifunctionally provides support to the window 20 by the provision of top and bottom extensions 17B, 17C that are punched from the same metal that forms the door 17 and the perimetric rim 25. The extensions are depicted in phantom prior to cutting and shaping the tabs 28 which function to support the window in the same manner as described earlier for the arrangement in FIG. 2. A similar gasket 23 is arranged around the rectangular aperture 19 formed in the door 17 and serves to environmentally seal the window. It is noted that the provision of part of the material that forms the door to also support the window realizes a substantial savings in materials and productivity since it leads to an automated assembly process without requiring either attachment or separate handling.

An electric disconnect enclosure has herein been disclosed. The enclosure improves over the environmental disadvantages of earlier enclosures requiring screws, rivets as well as additional manufacturing time and materials.

We claim:

1. An electric disconnect switch enclosure comprising:

a compartment having opposing top, bottom and sides joined by a back to form a rectangular closure open at a front thereof;

a hingeably mounted door on said front providing access to disconnect switch components within said closure;

a viewing window on said door arranged over a gasket positioned about an aperture formed within said door for providing visual access to disconnect switch components without requiring said door to be opened; and window support structure on an inner surface of said door, said support structure comprising a first plurality of tabs integrally-formed from said door extending from said inner surface at a top of said aperture and a second plurality of tabs integrally-formed from said door extending from a bottom surface of said aperture, said window being captured between said first and second tabs and said gasket in a press-fit relation.

2. The electric disconnect switch enclosure of claim 1 including a pair of downwardly-turned ends on said first tabs contacting a top edge of said window.

3. The electric disconnect switch enclosure of claim 1 including a pair of upwardly-turned ends on said second tabs contacting a bottom edge of said window.

* * * * *